US008002559B2

(12) United States Patent
Thiel et al.

(10) Patent No.: US 8,002,559 B2
(45) Date of Patent: Aug. 23, 2011

(54) CONTACT ELEMENT FOR PRESS FITTING INTO A HOLE OF A PRINTED CIRCUIT BOARD

(75) Inventors: Wolfgang Thiel, Denkendorf (DE); Jörg Graubmann, Eichstätt (DE); Dirk Riese, Nürnberg (DE); Marc Bechtle, Pforzheim (DE); Günter Stumpp, Straubenhardt (DE)

(73) Assignee: Conti Temic Microelectronic GmbH, Nurnburg (DE)

( * ) Notice: Subject to any disclaimer, the term of this patent is extended or adjusted under 35 U.S.C. 154(b) by 226 days.

(21) Appl. No.: 11/547,225

(22) PCT Filed: Mar. 4, 2005

(86) PCT No.: PCT/DE2005/000879

§ 371 (c)(1),
(2), (4) Date: Aug. 6, 2008

(87) PCT Pub. No.: WO2005/096447

PCT Pub. Date: Oct. 13, 2005

(65) Prior Publication Data

US 2009/0023310 A1 Jan. 22, 2009

(30) Foreign Application Priority Data

Mar. 30, 2004 (DE) ..... 10 2004 015 431

(51) Int. Cl.
*H01R 12/00* (2006.01)

(52) U.S. Cl. ..... 439/82; 439/751

(58) Field of Classification Search ..... 439/82, 439/733.1, 751, 943

See application file for complete search history.

(56) References Cited

U.S. PATENT DOCUMENTS

| | | | | |
|---|---|---|---|---|
| 4,762,498 | A * | 8/1988 | Harting et al. | 439/82 |
| 4,923,414 | A | 5/1990 | Sitzler | |
| 5,366,380 | A | 11/1994 | Reymond | |
| 5,564,954 | A * | 10/1996 | Wurster | 439/751 |
| 6,565,392 | B2 * | 5/2003 | Padro | 439/751 |
| 2003/0064631 | A1 | 4/2003 | Cabrera et al. | |

FOREIGN PATENT DOCUMENTS

| | | |
|---|---|---|
| DE | 90 02 176 | 4/1990 |
| DE | 199 34 709 | 2/2001 |

* cited by examiner

*Primary Examiner* — Thanh Tam Le

(57) ABSTRACT

Disclosed is a contact element for pressing into a hole of a printed circuit board. The contact element has a rod-shaped press-fit zone having an insertion region and an adjacent deformable region. The width of the deformable region is larger than the diameter of the hole, and the width of the insertion region is smaller than the diameter of the hole. The deformable region has a front region and a rear region that both have a closed opening, the openings being separated by a crossbar extending transversally to the insertion direction of the contact element. The crossbar extends at least in one part at a pointed angle of between 5 and 85 degrees to the insertion direction, and is thus subjected to an elastic force when the limbs are pressed together, creating a steadily increasing compression force for pressing the limbs against the wall of the opening.

11 Claims, 2 Drawing Sheets

CONTACT ELEMENT FOR PRESS FITTING INTO A HOLE OF A PRINTED CIRCUIT BOARD

BACKGROUND OF THE INVENTION

The invention relates to a contact element for press fitting into a hole of a printed circuit board having a hole for receiving a contact element.

The press fitting technique is a method to connected electrical contacts with printed circuit boards without using soldering. The press-fit contact has a deformable (flexible) or solid press-fit zone. The press-fit zone is oversized in relation to the corresponding bore hole in the PCB, which is coated with copper. The electrical contact between the press-fit pin and the PCB is produced by press fitting the pin with a mechanical force into the bushing, i.e. no solder or other auxiliary aids are used. The normal force required to maintain a stable and reliable connection is created by the elastic deformation of the press-fit zone (flexible pin) and the PCB (solid pin). In addition, the high mechanical pressure in the press-fit zone leads to cold welding.

With the flexible press fitting technique, the press-fit zone comprises an elastic deformable region. The deformation of the press-fit zone when press-fit causes a normal force to be applied to the surrounding copper bushing, which determines the retention force of the pin in the bushing. The most simple possible development of an elastic press-fit zone is the so-called Needle Eye Zone in the form of a needle eye. In the Needle Eye Zone, the press-fit limbs comprise on the outside a continuous concave curve. This geometry results in a very uneven force distribution over the length of the press-fit zone when press-fit. High force levels occur in a narrowly restricted area in the centre of the press-fit zone, while above and below, increased forces hardly occur, and the press-fit limbs are not in contact with the bushing over a wide area.

If the outer sides of the limbs are designed to be parallel in the deformable region, stress peaks occur on the edges of the deformable region, and low stress occurs in the centre, and the limbs may even bend inwardly in the centre.

A modified Needle Eye Zone is known from the First Publication DE 197 26 759 A1. This zone comprises a modified inner contour, which is intended to create a more even distribution of force during press-fitting.

Contact elements with flexible press-fit zones are known from EP 0 148 792 or EP 0 367 866 or U.S. Pat. No. 5,564,954, in which catches which face each other inwardly are formed on each of the limbs, which restrict the deformation of the limbs transverse to the direction of insertion accordingly, and which apply a corresponding counterforce onto the limbs during further compression. Here, the counterforce is initially very low, depending on the degree of compression of the limbs, and increases rapidly when the catches come into contact with each other. For a defined specification of the press-fit forces, therefore, a precise correlation is required between the diameter of the hole and the outer dimension of the limb and the inner dimension of the catch, and low-level deviations already lead to significant deviations in the press-fit forces achieved.

In addition, a contact element is already known from the category-defining DE 19934709, in which the deformable region comprises a front and a rear region, and the two regions each have a closed opening, which are separated by a crossbar which runs transverse to the insertion direction of the contact element, i.e. the limbs of these press-fit zones are separated by the openings, yet connected with each other by the crossbar.

The contact element comprises a constriction in the region of the crossbar, however, and is smaller in the front region, as a result of which the outer edges of the limbs which lie on the edge of the hole also fail to touch the hole over a sufficiently wide area, leading to uneven stress with a too high level of local fluctuation. The crossbar runs vertically to the insertion direction and is hardly able to have a springy elastic effect.

The object of the invention is therefore to provide a contact element which enables the safest and most even affixation and contacting in the opening of the printed circuit board. This object is achieved by a contact element for pressing into a hole of a printed circuit board. The contact element comprises a rod-shaped press-fit zone with an insertion region and an adjacent deformable region, and the deformable region has a width (D1) which is larger than the diameter of the hole. The insertion region has a width (D2) which is smaller than the diameter of the hole and the deformable region comprises at least two limbs (4, 4*a*) and in the insertion direction (F) a front (1) and a rear region (2), both of which having a closed opening, which are separated by a crossbar (3). The crossbar is curved in the form of a wave in the insertion direction (F), and runs at least in a partial section with a pointed angle ($\alpha$) between 5 and 85 degrees to the insertion direction (F).

SUMMARY OF THE INVENTION

The contact element comprises in the deformable region a front and a rear region, each with a closed opening, which are separated by a crossbar which runs transverse to the insertion direction, i.e. the contact element has at least two limbs which are separated in the deformable region by two openings, and which are connected with each other via the crossbar. The crossbar divides, as it were, the opening typical for Needle Eye Zones into two parts.

However, the crossbar runs at least in a partial region with a pointed angle between 5 and 85 degrees to the insertion direction, so that when the limbs are pressed together transverse to the insertion direction, due to the pointed angle, a bending stress of the crossbar in this region, and thus an even increase in the counterforce, is created. This crossbar supports the limbs outwards, thus ensuring through its elastically flexible deformation that an even stress is created, in particular with limbs which are essentially parallel in the deformable region on their outer sides which touch the edge of the opening.

The crossbar is curved in a wave form in the insertion direction, thus comprising curved regions in the insertion direction and at a level at which the insertion direction also lies, as opposed to the prior art, in which crossbars are curved at the most at the level which is vertical to the insertion direction.

The transfer region between the crossbar and the limbs is approximately vertical to the insertion direction, and the central section of the crossbar is accordingly set at an angle to the insertion direction, so that the bending stress is not at a maximum directly on the transfer point between the limbs and the crossbar.

Preferably, the contact element comprises a level at which both the contact element with the crossbar and the insertion direction lie, and the contact element is symmetrical in relation to this level.

The thickness of the crossbar, i.e. its dimensions in the insertion direction and the size of the pointed angle and the form of the crossbar depend significantly on the application, and should be adapted to requirements. Finally, an optimum can be found for a specified hole diameter, wherein a too thin crossbar is unable to generate sufficient counterforce, and in the centre of the deformable region, the limbs thus comprise an insufficient compression pressure onto the wall of the hole, while a too thick crossbar generates a counterforce which is too high, thus causing the limbs to be only sufficiently pressed in the centre of the deformable region.

The goal is to achieve a press force over the largest possible area and in the most even manner, which has a high mechanical stability between the contact element and the printed circuit board, and which is also a good current conductor.

BRIEF DESCRIPTION OF THE DRAWINGS

The present invention will now be described in greater detail below by way of exemplary embodiments and drawings. In the drawings.

DETAILED DESCRIPTION OF THE DRAWINGS

Figure 1A:
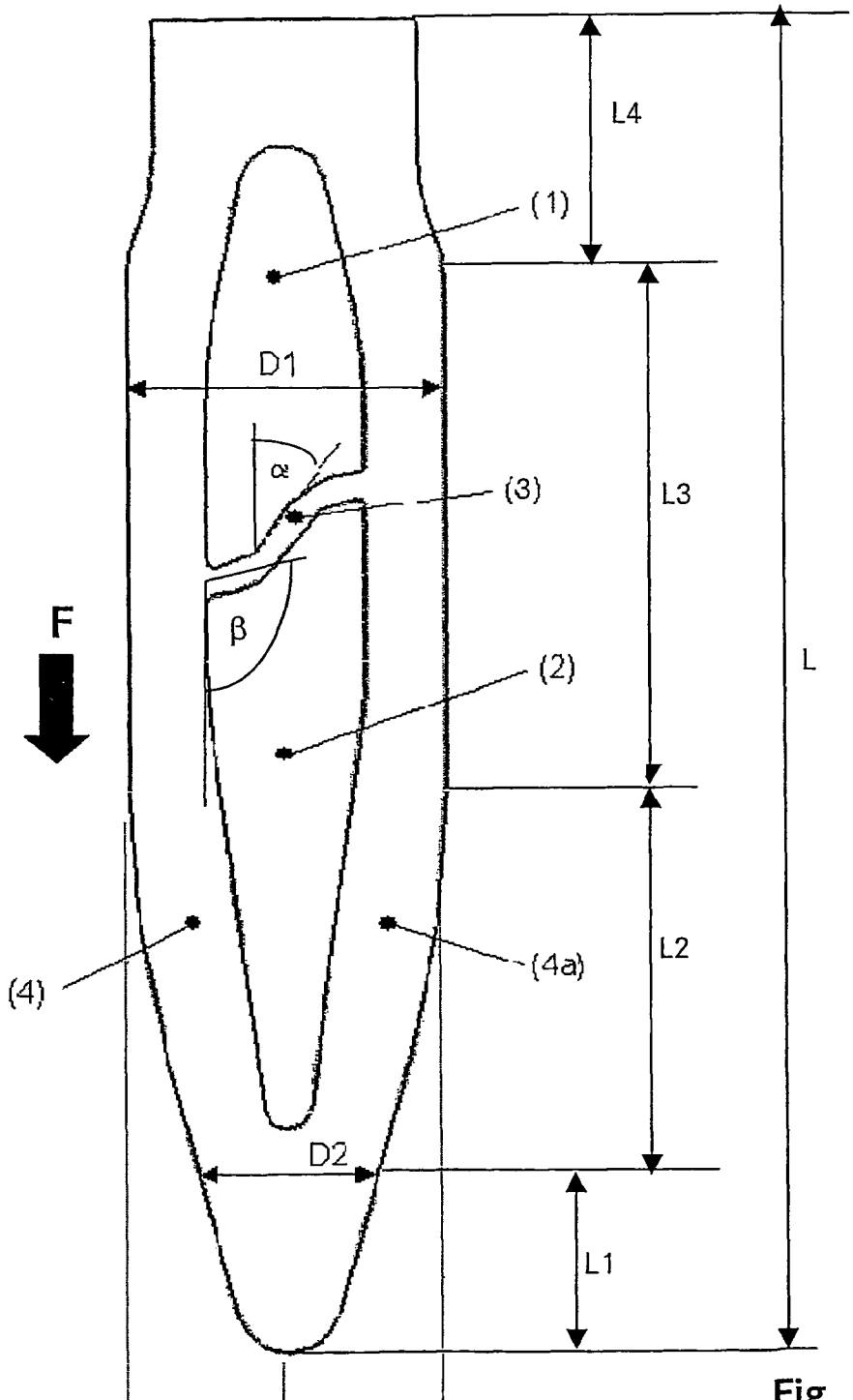
FIG. 1 shows a first design of the contact element in two views.
Figure 1B:
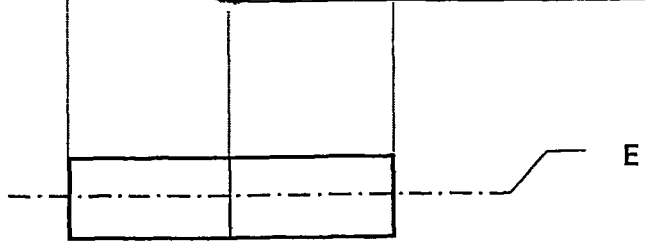

FIG. 1 shows a contact element for pressing into a hole of a printed circuit board, wherein the contact element comprises a rod-shaped press-fit zone with an insertion region (L1) and an adjacent deformable region (L2, L3).

The deformable region has a width (D1) which is larger than the diameter of the hole, and the insertion region has a width (D2) which is smaller than the diameter of the hole, so that the contact element can initially be inserted with the insertion region without force being required in the insertion direction F, while aligning itself in the hole due to the angular progress of the limbs in the transfer region L2.

The deformable region comprises a front (1) and a rear region (2), both of which having a closed opening, which are separated by a crossbar (3). The limbs (4, 4*a*) are thus separated in the deformable region by an elongated hole, which is subdivided into two openings by a crossbar which connects the limbs.

The crossbar runs at least in a partial region with a pointed angle ($\alpha$) between 5 and 85 degrees to the insertion direction F, here in this example, approx. 45 degrees. As a result of this angular position, when the contact element is pressed into the opening of the printed circuit board and the limbs 4, 4*a* are pressed together in the deformable region, the crossbar is subjected to an elastic force.

The limbs are essentially arranged parallel to each other in the deformable region above the length L3, and to the wall of the opening. When pressing into the opening occurs, the crossbar influences the centre of the deformable region and enables a more even pressure of the limbs over the entire length L3.

The two limbs (4, 4*a*) of the contact element are thus separated in the deformable region by the two openings, and in turn are connected with each other by the crossbar, wherein the crossbar comprises an approximately vertical transfer region to the limbs with an angle $\beta$, preferably between 75 and 90 degrees, and a central region running at an angle therebetween and having a pointed angle of between 5 and 85 degrees, e.g. approx. 45 degrees, to the insertion direction.

Figures 2A, 2B:
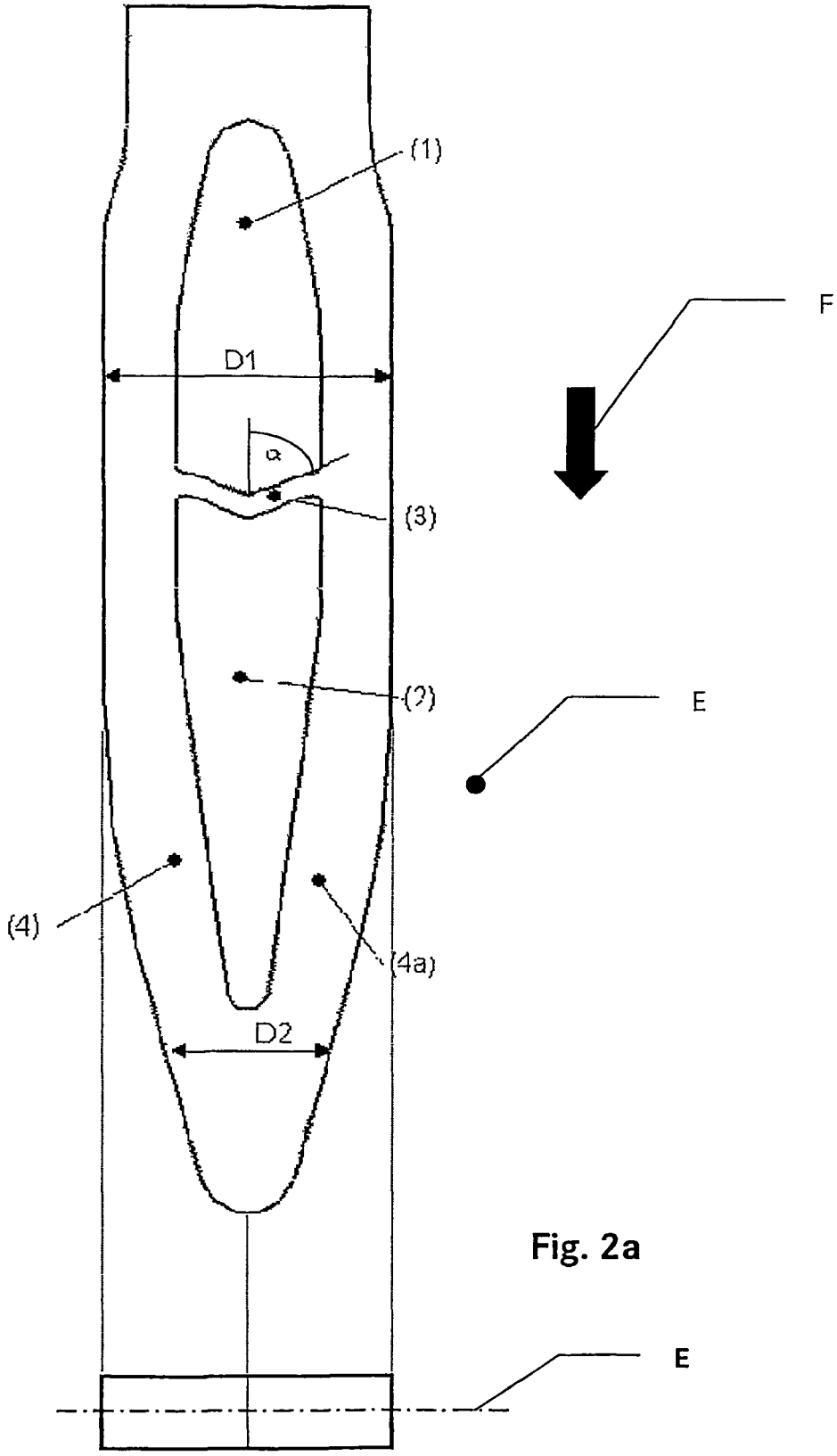
FIG. 2 shows a second design of the contact element in two views.

The transfers from the crossbar to the two limbs can be created at a height in relation to the insertion direction as shown in FIG. 2, or offset at a distance, as shown in FIG. 1. The crossbar (3) is preferably curved in a wave form.

The crossbar 3 according to FIG. 1 is essentially designed as a wave in the form of an S in the insertion direction (F) in such a manner that the central region runs at a pointed angle to the insertion direction F and together with the edge regions, leads continuously to a vertical transfer region to the limbs 4, 4*a*. As a result, on the two limbs in the insertion direction F, the transfer regions to the limbs are removed at different distances from the apex.

By contrast, the crossbar 3 according to FIG. 2 comprises in the central region a wave in the form of a V in the insertion direction (F). Both sections of the V form comprise a pointed angle to the insertion direction F. The crossbar 3 according to FIG. 2 additionally comprises the advantage that it is designed to be symmetrical to the insertion direction, and that the transfers to the crossbar are therefore at the same height.

Preferably, the contact element additionally comprises a catch on the side facing away from the insertion region, which restricts the length L of the contact element which can be inserted.

The contact element is generally designed at a single level, thus comprising a level E at which both the contact element with the crossbar and the insertion direction F lie. This level E corresponds to the level of the drawing in FIGS. 1*a* and 2*a*. The contact element is symmetrical in relation to this level, as shown in the transverse views 1*b* and 2*b*.

The invention claimed is:

1. A contact element for pressing into a hole of a printed circuit board comprising:

a rod-shaped press-fit zone having an insertion region and an adjacent deformable region, wherein the deformable region has a width (D1) which is larger than a diameter of the hole, and the insertion region has a width (D2) which is smaller than the diameter of the hole, wherein the deformable region comprises at least two limbs (4, 4*a*) extending in an insertion direction (F) that defined a closed opening, which are separated by a crossbar (3), wherein the crossbar is deformable to provide an even stress upon insertion of the two limbs into the hole and is curved in the form of a wave along with the insertion direction (F), and runs at least in a partial section with a pointed angle ($\alpha$) between 5 and 85 degrees to the insertion direction (F).

2. A contact element according to claim 1, wherein the crossbar comprises an approximately vertical transfer region to the limbs and a central region running at an angle therebetween and having the pointed angle to the insertion direction.

3. A contact element according to claim 1, wherein the crossbar (3) comprises the wave in the form of a V in the insertion direction (F).

4. A contact element according to claim 1, wherein the crossbar (3) is essentially designed as the wave in the form of an S in the insertion direction (F), in such a manner that the central area runs at the pointed angle to the insertion direction (F) and leads continuously to a vertical transfer to the limbs (4, 4*a*).

5. A contact element according to claim 1, wherein the limbs in the deformable region are essentially parallel in the deformable region on outer sides which touch an edge of the hole of the printed circuit board.

6. A contact element according to claim 1, wherein the contact element comprises one level (E) at which both the contact element with crossbar (3) and the insertion direction (F) lie, and wherein the contact element is symmetrical in relation to the level (E).

7. A contact element according to claim 1, wherein the contact element is provided as part of an electrical component.

8. The contact element according to claim 1, wherein the crossbar comprises a deformable element that is deformable responsive inward movement of the at least two limbs.

9. The contact element according to claim 8, wherein the crossbar comprises one continuous element that extends between the at least two limbs.

10. An electrical contact element for forming an electrical connection within an opening of a printed circuit board, the contact element comprising:

an insertion region including a first width that is smaller than the opening for receiving the contact element;

a deformable region including a second width that is larger than the opening that receives the contact element, wherein the deformable region includes two limbs that define a closed opening therebetween and a crossbar that extends across the opening, the crossbar is deformable to provide movement of the two limbs toward each other responsive to insertion into the opening, wherein the crossbar comprises a V-shape with a point of the V-shape along with a direction of insertion and wherein the crossbar exerts a desired basing force outwardly against movement of the two limbs toward each other when insert the two limbs into the opening for generating an even stress during insertion.

11. The electrical contact element as recited in claim 10, wherein the crossbar is disposed substantially transverse to a direction of insertion.

* * * * *